US008915288B2

(12) United States Patent
MacAllen et al.

(10) Patent No.: US 8,915,288 B2
(45) Date of Patent: Dec. 23, 2014

(54) CLAD PARTITION

(71) Applicant: molo design, ltd., Vancouver (CA)

(72) Inventors: Todd P. MacAllen, Vancouver (CA); Stephanie J. Forsythe, Vancouver (CA)

(73) Assignee: molo design, ltd., Vancouver (CA)

( * ) Notice: Subject to any disclaimer, the term of this patent is extended or adjusted under 35 U.S.C. 154(b) by 0 days.

(21) Appl. No.: 13/776,149

(22) Filed: Feb. 25, 2013

(65) Prior Publication Data

US 2013/0220557 A1 Aug. 29, 2013

Related U.S. Application Data

(60) Provisional application No. 61/602,435, filed on Feb. 23, 2012.

(51) Int. Cl.
*A47G 5/00* (2006.01)
*E04B 2/74* (2006.01)

(52) U.S. Cl.
CPC ..... *E04B 2/74* (2013.01)
USPC ..... 160/351; 160/84.05

(58) Field of Classification Search
USPC ..... 160/89, 135, 351, 84.05, 84.04, 160/DIG. 16; 24/303
IPC ..... E04C 2/405; B32B 3/12
See application file for complete search history.

(56) References Cited

U.S. PATENT DOCUMENTS

| | | | | |
|---|---|---|---|---|
| 2,101,836 A | | 12/1937 | Benedict | |
| 2,324,398 A | | 7/1943 | Kahr | |
| 2,346,824 A | | 4/1944 | Cohen | |
| 3,170,831 A | | 2/1965 | Paige | |
| 3,975,882 A | | 8/1976 | Walter | |
| 4,052,828 A | | 10/1977 | Mancini et al. | |
| 4,209,162 A | | 6/1980 | Petiau | |
| 4,307,768 A | * | 12/1981 | Anderson | 160/84.06 |
| 4,671,334 A | | 6/1987 | Yadegar et al. | |
| 4,694,144 A | | 9/1987 | Delaroche et al. | |
| 4,733,711 A | | 3/1988 | Schon | |
| 4,934,434 A | | 6/1990 | Schnebly et al. | |
| 4,958,671 A | * | 9/1990 | Bove | 160/135 |

(Continued)

FOREIGN PATENT DOCUMENTS

| | | |
|---|---|---|
| CA | 1166951 | 5/1984 |
| CA | 2586759 | 1/2008 |

(Continued)

OTHER PUBLICATIONS

Pedersen, Martin C.; "The Soft House"; Metropolis Magazine; Jul. 2004, New York.

(Continued)

*Primary Examiner* — David Purol

(74) *Attorney, Agent, or Firm* — John R. S. Orange; Blake, Cassels & Graydon LLP

(57) ABSTRACT

An article of furniture has a core formed from a cellular structure which is expandable upon movement of end faces away from each other. The exterior of the core presents a pair of oppositely directed undulating surfaces. An outer panel is juxtaposed with at least one of the undulating surfaces and secured to it. The outer panel is movable with the core to conform to the surface as the core is extended and retracted.

11 Claims, 8 Drawing Sheets

(56) References Cited

U.S. PATENT DOCUMENTS

| | | | | |
|---|---|---|---|---|
| 4,970,831 | A | 11/1990 | Rota | |
| 5,078,195 | A | 1/1992 | Schon | |
| 5,172,530 | A * | 12/1992 | Fishel et al. | 52/36.1 |
| 5,193,601 | A | 3/1993 | Corey et al. | |
| 5,238,515 | A * | 8/1993 | Insalaco et al. | 156/201 |
| 5,373,916 | A | 12/1994 | Kiviniemi et al. | |
| 5,406,760 | A | 4/1995 | Edwards | |
| 5,690,778 | A | 11/1997 | Swiszcz et al. | |
| 6,019,864 | A | 2/2000 | Jones | |
| 6,283,191 | B1 | 9/2001 | Lo | |
| 6,427,409 | B2 | 8/2002 | Colson et al. | |
| 6,431,936 | B1 | 8/2002 | Kiribuchi | |
| 6,527,895 | B1 | 3/2003 | Palmer | |
| 6,764,200 | B1 | 7/2004 | Wu Liu | |
| 6,959,752 | B2 | 11/2005 | Huang | |
| 7,195,051 | B2 * | 3/2007 | Nien | 160/243 |
| 7,730,925 | B1 * | 6/2010 | Pereira | 160/84.04 |
| 8,066,050 | B2 * | 11/2011 | Lin | 160/84.04 |
| 2001/0009179 | A1 | 7/2001 | Huang | |
| 2002/0179558 | A1 | 12/2002 | Venegas, Jr. | |
| 2003/0156426 | A1 | 8/2003 | Givoletti | |
| 2006/0082987 | A1 | 4/2006 | Dorsey et al. | |
| 2006/0157204 | A1 * | 7/2006 | Lin | 160/84.04 |
| 2006/0260231 | A1 | 11/2006 | MacAllen et al. | |
| 2009/0230734 | A1 * | 9/2009 | Stell | 297/16.1 |
| 2009/0294078 | A1 * | 12/2009 | Feldpausch et al. | 160/377 |
| 2011/0088852 | A1 * | 4/2011 | Hu et al. | 160/84.05 |

FOREIGN PATENT DOCUMENTS

| | | | |
|---|---|---|---|
| WO | 2005056899 | A1 | 6/2005 |
| WO | 2007048951 | A1 | 5/2007 |
| WO | 2008144537 | A1 | 11/2008 |
| WO | 2010072003 | A1 | 7/2010 |

OTHER PUBLICATIONS

Dempster, Victoria; International Search Report from the corresponding PCT Application No. PCT/CA2009/001903; search completed on Apr. 19, 2010.

http://www.balkanyug.bg/new/index.php?page=shop.browse&category_id=103&option=com_virtuemart&Itemid=4—products of Balcan Yug OOD from Haskovo, Bulgaria; retrieved from the Internet May 1, 2013.

http://www.lessocentercom/products-49.html—products of Lesoncentar OOD, Trojan, Bulgaria; retrieved from the Internet May 1, 2013.

http://kori-vrati.g-m.bg/—products of G&M from Varna, Bulgaria; retrieved from the Internet May 1, 2013.

Timmyvirus111; "Flexible Love" Folding Chair; http://www.youtube.com/watch?v=LbEEXMIhZR0; retrieved from the Internet May 1, 2013.

Rushtang72; Paper Sofa Folding Chair Carton Furniture; http://www.youtube.com/watch?v=8s5cWX6QyBs; retrieved from the Internet May 1, 2013.

Paparazzia; Folding Chair; http://www.youtube.com/watch?v=t9dNbQCHfMc; retrieved from the Internet May 1, 2013.

ONETWO easy-2-do event furniture; Product Catalogue 2005.

Acknowledgment of receipt of observations by third parties (Art. 115 EPC); issued in corresponding EP Patent Application No. EP09833988; dated Jun. 15, 2011.

* cited by examiner (a)

(b)

CLAD PARTITION

This application claims priority from U.S. Provisional Application No. 61/602,435 filed on Feb. 23, 2012, the contents of which are incorporated herein by reference.

FIELD OF THE INVENTION

The present invention relates to flexible furniture components and methods of making such components.

DESCRIPTION OF THE PRIOR ART

Furniture is a staple product used in domestic, working and public environments. Furniture may be used to facilitate the use of space, such as in a seat or table, or to divide space, such as in a partition. By way of example, partitions are frequently used to subdivide spaces, or to create more intimate spaces. Typically such partitions are rigid, or have rigid frames, or are formed from rigid interconnected panels and they are relatively large, heavy, and cumbersome, and therefore difficult to set-up, take down, store, and transport. Similarly other items of furniture, such as seating structures, are typically of a rigid, or permanent nature that, at most, are moveable to alternative locations.

Moreover, the inherent rigidity of such items of furniture limits the extent to which they can be dynamically resized (extended or contracted) and reshaped to suit varying spaces and requirements, or readily moved around for relocation, or storage.

Additionally, such furniture items, particularly in the form of partitions are typically formed from opaque panels which inhibit the transmission of light, therefore necessitating increased use of or rearrangement of artificial lighting to restore adequate lighting levels.

In domestic, working, and public environments it is frequently desirable to be able to subdivide and reshape space on a temporary basis. For example, visitors may require a temporary sitting or sleeping area, office workers may need to convert an open plan area into subdivided working space or temporary meeting space, trade show participants may need to demarcate a temporary display area, and designers may need to create and shape a temporary area for an event, or a backdrop for a designed area, such as in a window display in a retail setting, in a showroom, or in a theatrical setting. For these types of applications, furniture components that are rigid, wavy, and/or cumbersome may be costly to transport, difficult to set up/take down, and may require significant storage space. Furniture in the form of a partition that is rigid will also place significant constraints on the ways in which a given space can be partitioned, limiting its functionality, and a partition that is fully opaque will severely disturb natural lighting.

In PCT Application No. WO 2010/072003 there is shown a furniture which has a core form from laminar panels to provide a cellular structure that can be extended and retracted. Provision is made for connecting the panels end-to-end and for utilizing the panels in different configurations as different articles of furniture. In each of these arrangements, the cellular core is directly visible and therefore affects the aesthetics of the core.

In certain applications it is desirable for particular materials to be used, for structural considerations or safety concerns, and the aesthetics of those materials are less than optimum. Moreover, surface finishes are difficult to apply to some of those materials.

It is therefore an object of the present invention to provide articles of furniture in which the above disadvantages are obviated or mitigated.

SUMMARY OF THE INVENTION

According therefore to one aspect of the present invention there is provided an article of furniture having a core formed from a plurality of laminar panels of a flexible flaccid material. Each panel has a pair oppositely-directed major faces with faces of adjacent panels being inter-connected to provide a cellular structure upon movement of the faces away from each other and present a pair of oppositely directed undulating surfaces, an outer panel, juxtaposed or at least one of said undulating surfaces and secured thereto, said outer panel being movable with said core to conform a to said surface as said core is extended and retracted.

Preferably, said panel is realisably secured to said undulating surface. Preferably also, said panel is pleated to conform to said undulating surface.

BRIEF DESCRIPTION OF THE DRAWINGS

Embodiments of the invention will now be described by way of example only with reference to the accompanying drawings in which.

DETAILED DESCRIPTION OF THE INVENTION

Figure 1:
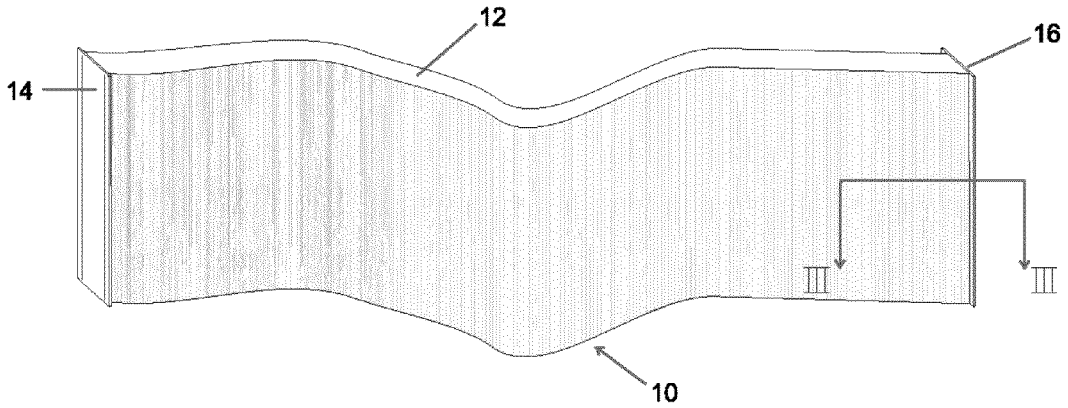
FIG. 1 is a front perspective view of a partition.

Referring therefore to FIG. 1, a partition 10 comprises a core 12 and a pair of supports 14, 16 at opposite ends of the core 12. As can best be seen from FIGS. 2 and 3, the core 12 is formed from a plurality of panels 18. The panels 18 each have a pair of oppositely-directed major faces 19, 20, and are formed from a flexible flaccid material. In the preferred embodiment, the material forming the panels 18 is standard white, flame retardant tissue paper, having a weight of approximately 13.5 lbs (500 sheets @ 24"×36"=13.5 lbs).

It will be apparent that alternative materials may be used that fulfil the same functional requirements. For example, it is possible to utilize a heavier weight paper material, such as Kraft paper, or a non-woven textile material, such as a plastic material known as Tyvek from DuPont, which is both tear and water resistant. Alternatively, a paper laminated with a plastic film to provide a composite material may be used. With such a core material, the supports 14 may be made of a felt or may be made from a material similar to the core material but with increased thickness. It is preferred that the material used in the support, is sufficiently flexible to allow folding to define the tubular support structure at each end with fasteners 34 such as magnets or loop and book strips incorporated on the support. In some applications, the inherent stiffness of the material used in the core is such as to provide sufficient rigidity to the core when the cellular structure is expanded for the core to be self supporting when expanded. Kraft paper or plastics material has provided sufficient rigidity for this purpose. In this case the supports may be provided to permit connectivity if multiple units are to be joined end to end.

Figure 2:
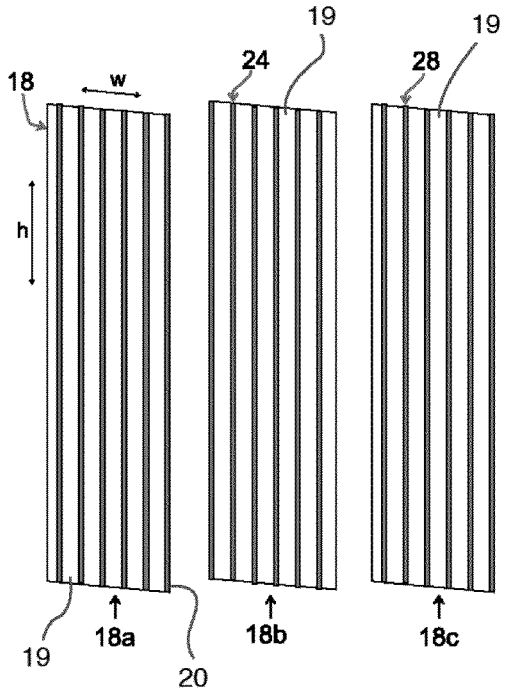
FIG. 2 is a perspective view showing three of the panels used to form the partition of FIG. 1.
Figure 3:
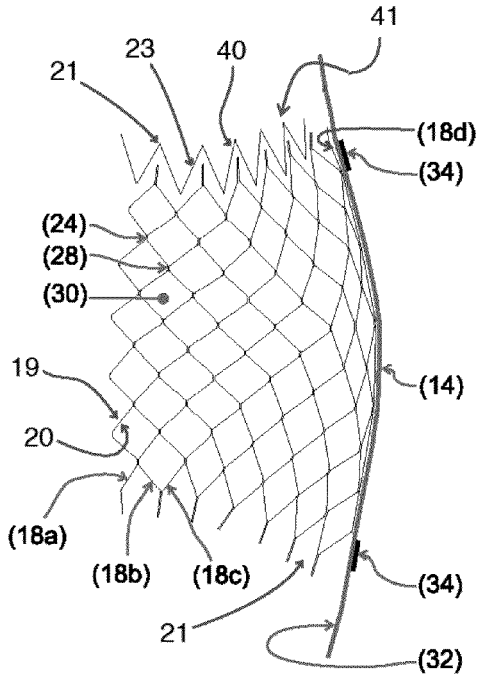
FIG. 3 is a view on the line III-III of FIG. 1.

Each panel has a major dimension or height h and a width w which may be adjusted to suit particular environments. Typically the height win be in the order of 1-2 meters but could range from 0.5-3 meters when used as a partition, or 0.1 meters to 0.5 meters when used as a seat. A seat height of 0.45 m has been found particularly beneficial. The width is typically in the order of 30 centimeters but could range from 10-100 centimeters. Adjacent panels 18 are inter-connected to one another at spaced intervals that alternate across the width of the face of the panel 18. As indicated in FIG. 2, the connection between panels 18*a* and 18*b* is through a series of parallel, laterally-spaced strips 24 on the face 19 of panel 18*b*. The strips 24 are defined by stripes of adhesive, which connects the panels 18*a*, 18*b* to one another, as shown in FIG. 3.

Similarly, the inter-connection between a panel 18*b* and 18*c* is through spaced parallel strips 28 on the face 19 of panel 18*c* which are offset from the strips 24. Each of the panels 18 is therefore alternately connected to the panel 18 on opposite sides so that, as shown in FIG. 3, upon extension of the panel in a horizontal direction, a cellular structure having voids 30 is formed within the core. The voids 30 extend vertically from top to bottom of the core 12 with the panels 18 providing a continuous transverse barrier. The lateral outer ends of each of the panels 18 are connected so as to form a pair of undulating surface 21 defined by vertical pleats 23. An outer panel 40 is juxtaposed with undulating surface 21, as will be described in more detail below.

An end panel 18*d* of the core is connected to respective ones of the supports 14 and 16 over its entire width. The supports 14 and 16 are made from a self-supporting material, such as a non woven felt material, which has a degree of flexibility but also has sufficient rigidity to resist collapse of the core 12 or, preferably, polypropylene sheets. Where felt is used, the felt is a 1.95 nominal pounds per square yard felt having a thickness in the order of 3 millimeters, although other weights and thicknesses may be utilized as appropriate depending upon the overall dimensions of the partition 10. Where polypropylene is used a thickness of 2 millimeters has been found to provide the requisite stiffness. The supports 14 and 16 extend laterally beyond the core as indicated at 32 and are adhered to respective ones of the end panels 18*d*.

Fasteners 34 in the form of a pair of loop and hook strips, such as that sold under the trade name "Velcro" are stitched to the felt supports 14 and 16, and extend vertically from one end to the other. Alternatively, and preferably, magnets can be embedded in the supports, as described more fully in PCT Application No. WO 2010/072003, the contents of width are incorporated herein by reference. In that case, the magnets are embedded in the polypropylene end panels and covered by material similar to that of panels 18.

The outer panel 40 is made from a material having the desired aesthetic characteristics and may be patterned or carry information such as a corporate logo to meet the particular needs and uses. The panel 40 is pleated, as indicated at 41, so as to conform generally to the pleats 23 on the undulating surface 21. Where a close conformance to the undulating surface is required, pleats in the order of 2-3 millimeters longer than the pleats 23 is found to be desirable.

Figure 9:
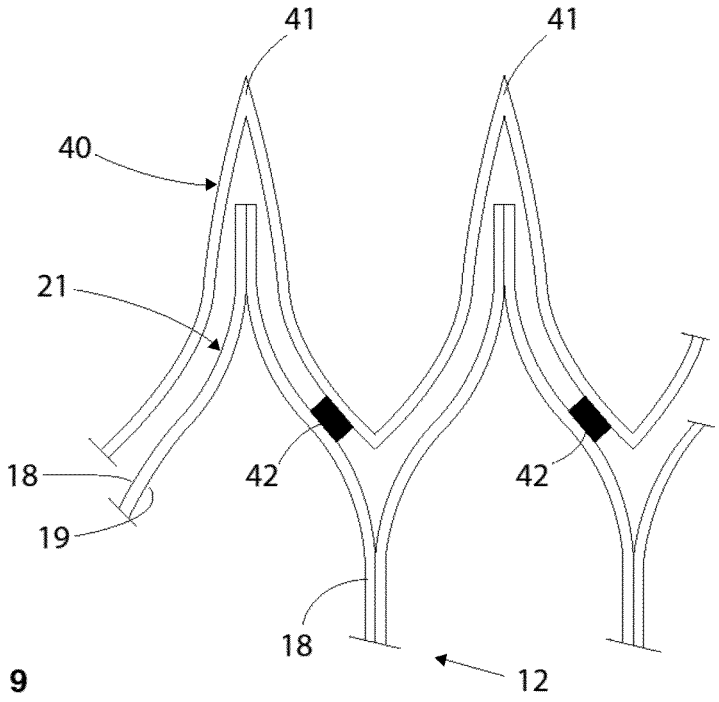
FIG. 9 is a plan view on an enlarged scale of the panel of FIG. 1.

As shown in FIG. 9, the panel 40 is secured to the undulating face by fasteners 42 at spaced intervals along the core. The fasteners 42 may be a permanent fastener, such as an adhesive or, preferably a releasable fastener, such as hook and loop fasteners or magnetic connectors. The magnetic connectors may be provided by magnetic ink on one of the panels and a magnetic material deposited on the other panel.

The fasteners 42 need not be secured to each of the pleats 23 but spaced at sufficient intervals to ensure that the panel 49 is held against the undulating surface 31 as the core is extended and retracted.

The panel 40 may be made front a resilient material, printed with the desired pattern and permanently creased to provide the pleats. The panel 40 may then be juxtaposed with the undulating surface 21 so that the pleats 41 of the panel are interdigitated with the pleats 23.

Figure 10:
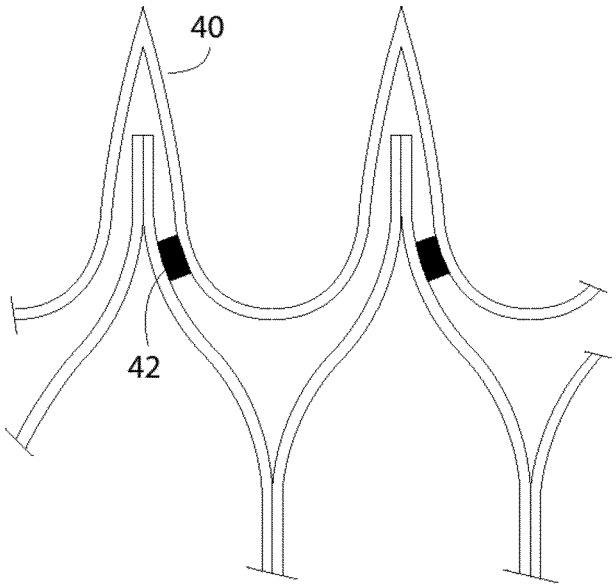
FIG. 10 is a plan view, similar to FIG. 9 of an alternative embodiment.

The provision of the panel 40 also allows the characteristic of the undulating surface to be changed. As shown in FIG. 10, the pleats on the panel 40 may be shorter than those on the undulating surface 21 so that a curved undulating surface is obtained.

Figure 11:
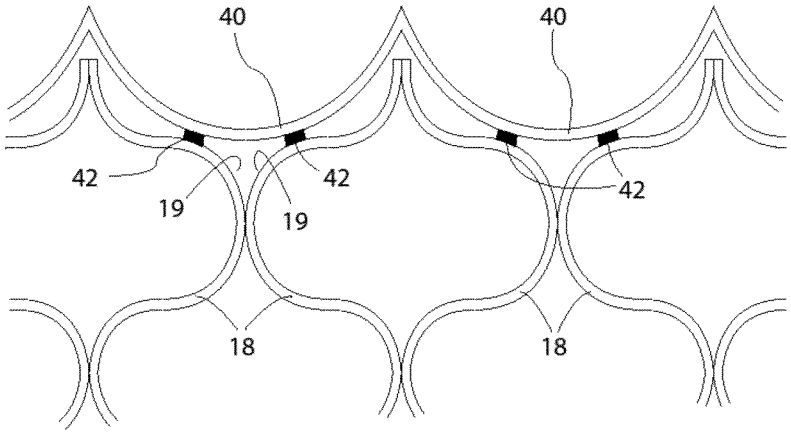
FIG. 11 is a plan view similar to FIG. 9 of a still further embodiment.
Figure 12:
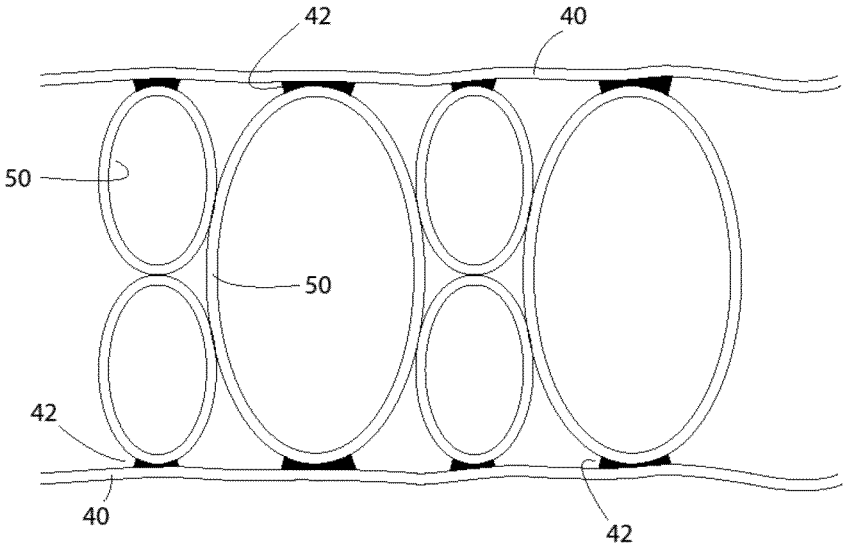
FIG. 12 is a view, similar to FIG. 3, of an alternative cellular structure.
Figure 13:
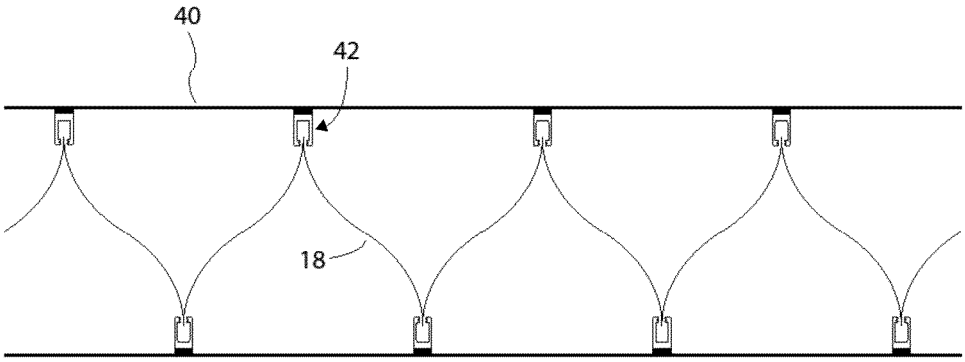
FIG. 13 is a view, similar to FIG. 3, of a further embodiment.
Figure 14:
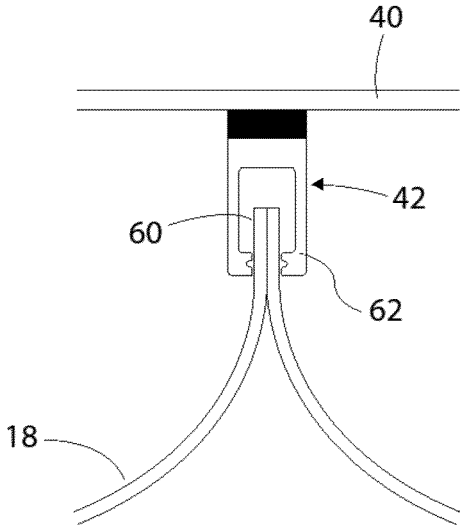
FIG. 14 is an enlarged view of a portion of the embodiment shown in FIG. 13.

It will also be appreciated that the core can have cellular structures, other than the honey comb structure illustrated in FIG. 3. The core 12 may have a series of convex pleats 23 as shown in FIG. 11. Further alternative structures are shown in FIGS. 12 to 14, as described in more detail below.

Of course a panel may be attached to each of the undulating surfaces 21 or to only one of those surfaces depending on the particular application.

Figure 4:
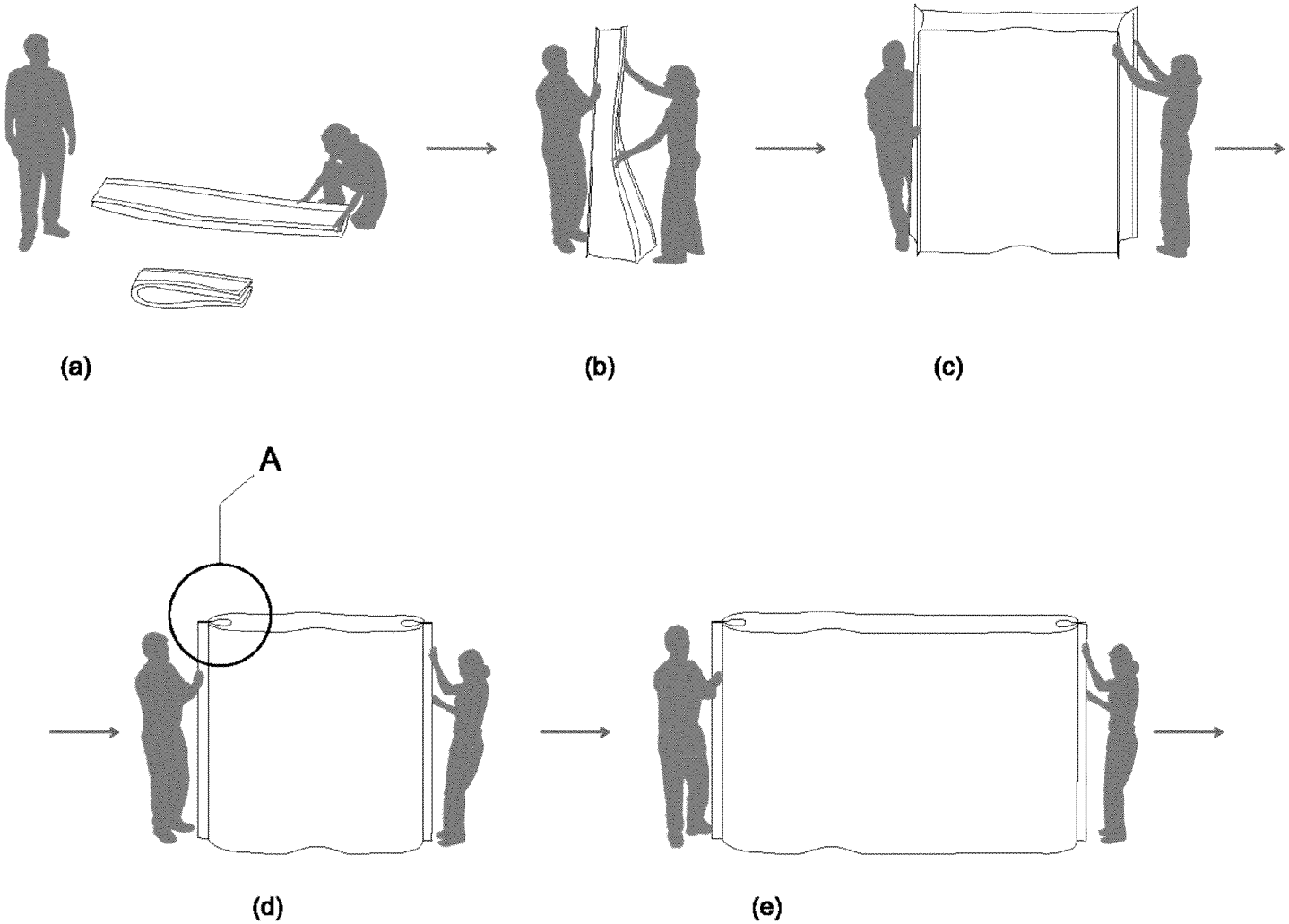
FIG. 4 is a series of views showing the sequential operations required to erect the panel of FIG. 1.

The core 12 is collapsible so that the major faces of adjacent panels 18 lay parallel to one another and in abutment. In this position, as shown in FIG. 4*a*, the partition 10 may be stored in as flat, collapsed position. The panel 40 is nested within the pleats 23. When the partition 10 is required, it can be oriented vertically (FIG. 4*b*) and the opposite supports 14 and 16 used to manipulate the partition. The supports 14 and 16 are moved away from one another as shown in FIG. 4*c* to expand the core so that the cellular structure is opened within the core 12. The lateral extension of the supports 14, 16 beyond the core 12 provides marginal tabs that may be grasped to facilitate manipulation of the core without direct contact with the panels 18. As the core extends, the panel 40 also extends with the fasteners 42 ensuring conformance with the surface 21.

Figure 5:
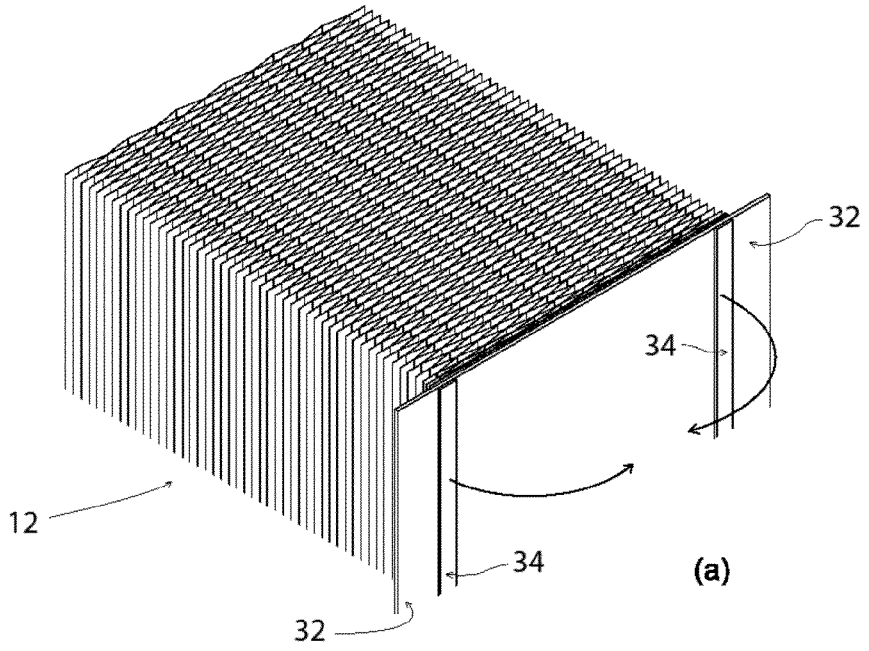
FIG. 5 is a detailed view of the portion shown in circle A in FIG. 4.
Figure 5:
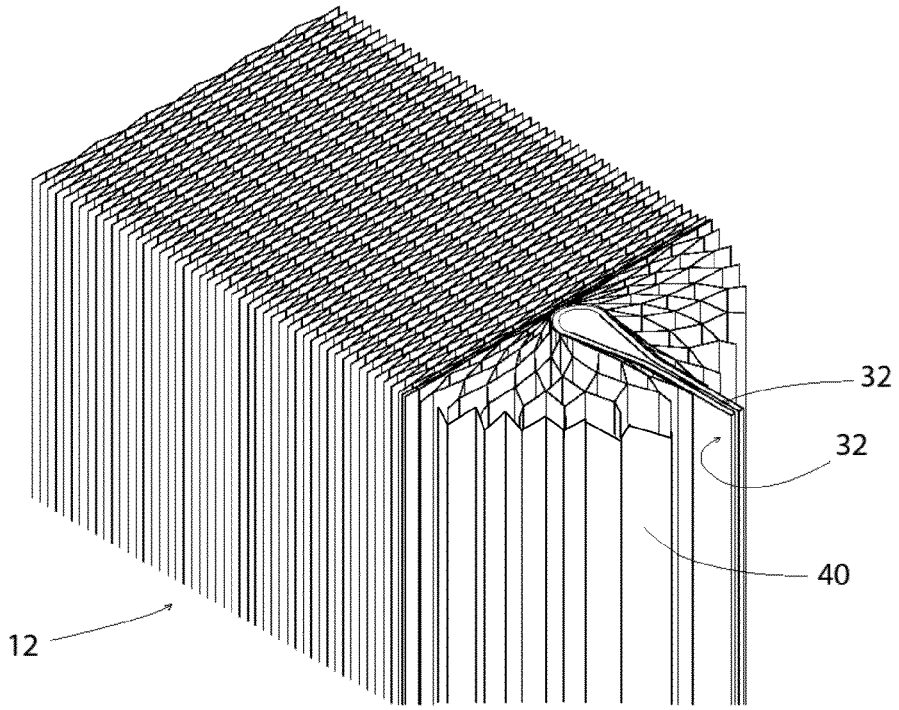

Once partially extended, the supports 14 and 16 may be folded along a vertical axis to provide enhanced rigidity at each end of the partition 12. This may be seen in more detail in FIG. 5 where it will be seen that the opposite edges of the supports 14 and 16 may be brought together so that fasteners 34 are brought into abutment. The fasteners 34 engage one another and thus hold the support in a folded tubular configuration by magnetic attraction, where magnets are used, or by engagement of the hook and loop material if that is used. This movement is accommodated by the flexible nature of the cellular structure which expands towards the lateral edges to accommodate the folding of the supports 14 and 16. The panel 40 also is carried with the outer surface 21 to "wrap" the supports. With the supports 14 and 16 folded into a tubular support, extension of the core 12 continues as shown in view (e) of FIG. 4, until the desired overall length is reached.

With the partition 10 expanded, it has sufficient width to remain stable in a vertical position with the rigidity provided by the end supports 14 and 16. The material forming the panels 18 and/or outer panel 40 may be translucent so that a pleasing transmission of light through the panel may occur, while still providing a degree of privacy.

Figure 8:
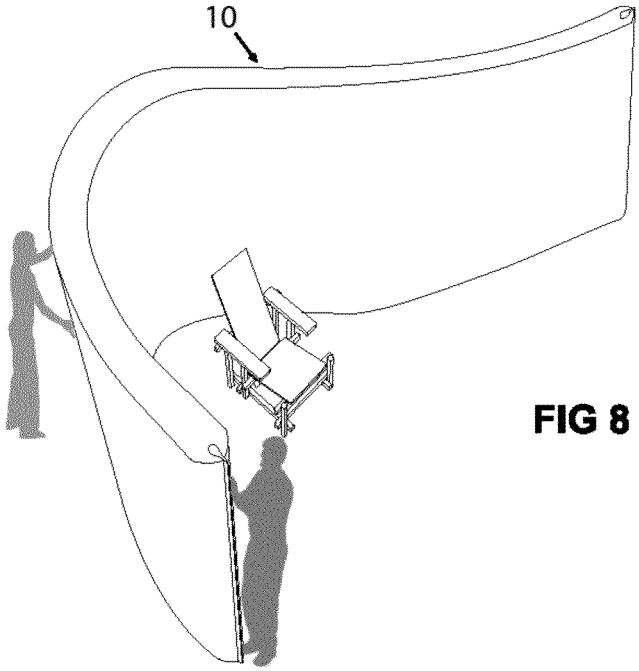
FIG. 8 is a top perspective view showing the arrangement of a panel within a living area.

The extended partition as shown in FIG. 4*e* may be adjusted to different configurations as illustrated by the open curve shown in FIG. 1 and the wrapped curve shown in FIG. 8, in each configuration, the panel 40 moves with the core to maintain the aesthetic appeal. The core 12 has a surprising degree of flexibility to accommodate different configurations and allow an appropriate shaped and sized partition to be installed in an otherwise open space. By varying the overall dimensions, additional functionality may be obtained. The extended partition shown in FIG. 4*e* may also be made with a lower height, for example 1 meter and a wider base, for example 0.5 meters so that the top surface of the partition may be used as an area to display objects. Such an arrangement is illustrated in FIG. 9. Where appropriate, the terminal portions of the voids 30 may be used as a pocket to support a container, such as a vase, or similar object, in this embodiment, the height would be between 0.5 and 1.5 meters.

Figure 6:
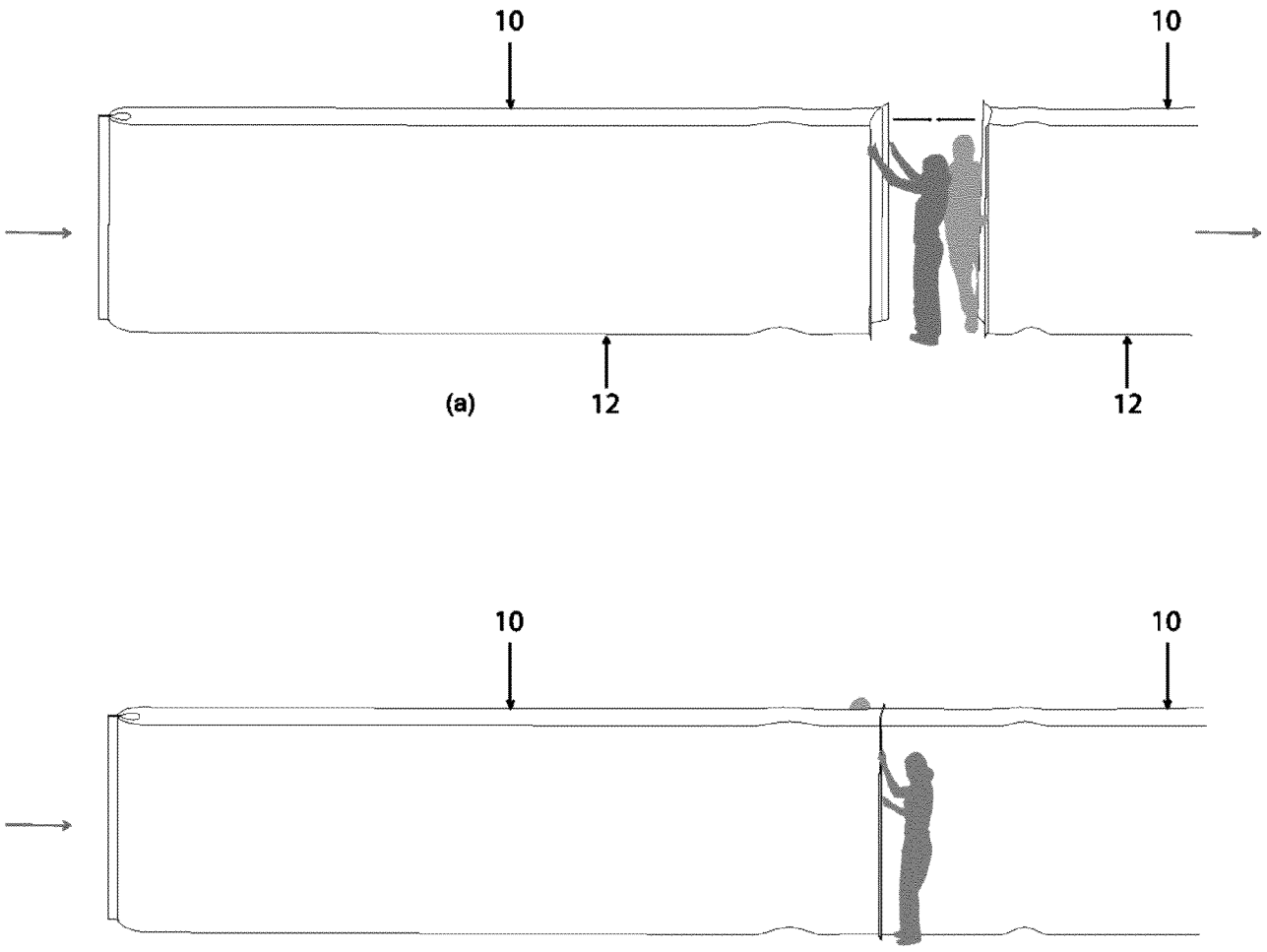
FIG. 6 is to view showing the sequential steps to join a pair of panels shown in FIG. 1 end-to-end.
Figure 7:
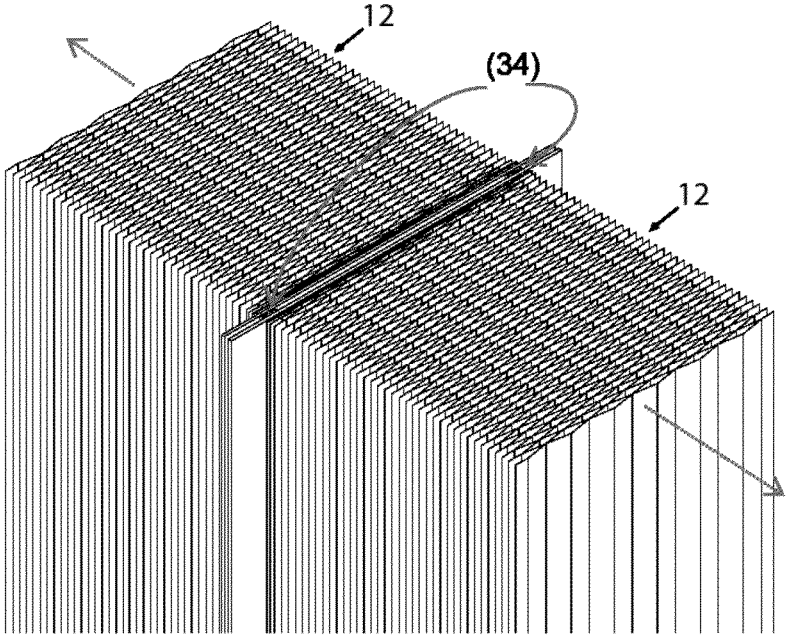
FIG. 7 is a detailed view of the inter-connection of the panels shown in FIG. 6.

The provision of the supports 14 and 16 also permits a pair of partitions 10 to be joined end-to-end as shown in FIG. 6. As may be seen from FIG. 6*a*, a pair or partitions 10 is erected and positioned with supports 14, 16 at opposite ends of each partition adjacent one another. The fasteners 34 in adjacent supports 14, 16 are then brought into contact with one another as shown in FIG. 7 so that the partitions 10 are joined in seriatim. The additional thickness provided by the double support at the intersection enhances rigidity, with the supports 14, 16, at the free ends of the partition being folded upon themselves to provide stable support. Again therefore, a panel 40 may be provided on each of partitions 10 to provide a continuous aesthetically pleasing appearance. The panels 40 may be different to provide different information or identical to provide a continuous wall.

After use of the partition 10, it is simply necessary to reverse the procedure by moving the ends towards one another, unfolding the supports 14 and 16, and collapsing the core 12 to its minimum size. It may then be stored and used when subsequently required.

Whilst a translucent material is often preferred, it will be apparent that opaque or different coloured materials may also be utilized. The dimensions of the void 30 and the number of voids in the lateral direction may be adjusted to suit particular applications. It has been found in practise that a spacing between stripes 24, 28 in the order of 5-10 centimeters when unexpanded) is appropriate, although spacing as low as 1 cm, may be used, and that the width of the stripes 24, 28 is between 1 and 10 millimeters. This arrangement provides a flexible structure with extensive elongation to provide maximum functionality.

As noted above, the core 12 may have alternative structures, as may be seen in FIGS. 11 to 14.

In the embodiment of FIG. 11, the panels 18 are formed from a material that adopts a curvilinear structure when expanded, due to the bending stiffness of the material. The panels 18 are connected at their edges and fasteners 42 used to secure the panel 40 to convex outwardly directed faces 19. As shown, the panel 40 is pleated to accommodate the apices of the core 12, but do not closely conform to the outer surfaces 19 to provide a curved appearance to the panel 40.

In the embodiment of FIG. 12, the core 12 is formed from tubes, 50, of differing diameters, which are connected to one another to provide a cellular structure. The tubes 50 fold along lateral diameters to permit expansion and contraction of the core.

A panel 40 secured by fasteners 42 to opposite sides of the core 12 so that both sides are covered. The panel 40 is flaccid to fold into the space between the tubes 50 as the core 12 is retracted. Lines of weakness, fold lines or pleats may be included to facilitate folding of the panel 40 in an orderly manner.

A further arrangement is shown in FIGS. 13 and 14 where the core 12 is defined curved panels 18. The panels 18 have sufficient rigidity to maintain the curved shape when extended and retracted, and the profile may be chosen to permit nesting of the panels when collapsed.

The lateral edges 60 of the panels 18, are connected to one another by mechanical clips 62 that extend along the length of each panel 18. The clips 62 provide an attachment point for fasteners 42 that hold an outer panel 40 in position.

The panel 40 may be flaccid and pleated, as described above, or may be resilient in the direction of extension so as to remain taut as the core 12 is extended. Where the outer panel 40 is resilient, attachment may only be required at either end or core 12, where an outer panel is required on both sides of core 12, then a resilient sock may be used about the core so as to be extensible with the core.

The invention claimed is:

1. An article of furniture comprising a core formed from a plurality of laminar panels of a flexible flaccid material, each panel having a pair of oppositely-directed major faces with faces of adjacent panels being inter-connected to provide a cellular structure upon movement of the faces away from each other and present a pair of oppositely directed undulating surfaces, an outer panel, juxtaposed with at least one of said undulating surfaces and secured thereto, said outer panel being movable with said core to conform to said undulating surface as said core is extended and retracted, said outer panel comprising pleats and one or more facing surfaces corresponding to one or more of said pleats are secured to one or more facing surfaces on said undulating surface, and ridges of said one or more pleats are detached from said undulating surface.

2. The article of claim 1 wherein said outer panel is releasably secured to said undulating surface by fasteners.

3. The article of claim 2 wherein said fasteners are hook and loop fasteners.

4. The article of claim 2 wherein said fasteners are magnetic.

5. The article of claim 4 wherein said fasteners include a magnetic ink on one of said outer panel and undulating surface.

6. The article of claim 1 wherein said outer panel has a pattern on an outwardly directed surface.

7. The article of claim 1 wherein said outer panel is pleated and complimentary to said core.

8. The article of claim 1 wherein said core has a honey comb cellular structure.

9. The article of claim 1 wherein said core is formed from a plurality of tubes foldable along lateral diameters.

10. The article of claim 1 wherein said core is defined by a plurality of inter connected curved panels.

11. The article of claim 1 wherein said outer panel is resilient.

* * * * *